US006749087B1

(12) United States Patent
Robinson

(10) Patent No.: US 6,749,087 B1
(45) Date of Patent: Jun. 15, 2004

(54) TUBE CLIP FOR A COILED TOOTHPASTE TUBE

(76) Inventor: Donald F. Robinson, 151 S. Craig Pl., Lombard, IL (US) 60148

( * ) Notice: Subject to any disclaimer, the term of this patent is extended or adjusted under 35 U.S.C. 154(b) by 0 days.

(21) Appl. No.: 10/341,046

(22) Filed: Jan. 13, 2003

(51) Int. Cl.[7] ..... B65D 35/00

(52) U.S. Cl. ..... 222/99; 222/1; 222/95; 222/97; 222/103; 24/563

(58) Field of Search ..... 222/1, 95, 99, 222/100, 103, 97; 24/563

(56) References Cited

U.S. PATENT DOCUMENTS

| | | | | | |
|---|---|---|---|---|---|
| 341,710 | A | * | 5/1886 | White | 24/561 |
| 1,250,985 | A | | 12/1917 | Day | |
| 1,773,104 | A | | 8/1930 | Johnson | |
| 1,839,542 | A | | 1/1932 | Ferguson | |
| 1,845,291 | A | | 2/1932 | Koontz | |
| 1,894,152 | A | | 1/1933 | Bolz | |
| 1,941,631 | A | | 1/1934 | Socoloff et al. | |
| 1,983,462 | A | | 12/1934 | Johnson | |
| 2,035,713 | A | | 3/1936 | McMackin | |
| 2,054,990 | A | | 9/1936 | Newton et al. | |
| 2,097,308 | A | | 10/1937 | Ruth | |
| 2,133,754 | A | | 10/1938 | Oscar | |
| 2,179,012 | A | | 11/1939 | Kach | |
| 2,531,060 | A | | 11/1950 | Krueger | |
| 2,614,729 | A | | 10/1952 | Jung | |
| 2,754,031 | A | | 7/1956 | Ostrov et al. | |
| 2,760,681 | A | | 8/1956 | Arquelles et al. | |
| 2,822,111 | A | | 2/1958 | Tripoli | |
| 2,851,194 | A | | 9/1958 | Krystosek | |
| 2,862,647 | A | | 12/1958 | Dietz | |
| 2,903,162 | A | | 9/1959 | Regan | |
| 3,074,598 | A | | 1/1963 | Barton | |
| 3,217,930 | A | | 11/1965 | Battaglini | |
| 3,241,721 | A | | 3/1966 | Freeman | |
| 3,275,195 | A | | 9/1966 | Reinstra | |
| 3,628,696 | A | | 12/1971 | Dulker | |
| 3,701,459 | A | | 10/1972 | Ward | |
| 3,917,118 | A | | 11/1975 | Odgen | |
| 4,205,764 | A | | 6/1980 | Gill | |
| D274,772 | S | | 7/1984 | Obland | |
| 4,607,763 | A | | 8/1986 | Wright | |
| 4,627,551 | A | | 12/1986 | Kopp | |
| 4,629,095 | A | | 12/1986 | Smith | |
| 4,664,293 | A | | 5/1987 | Sheppard | |
| 4,833,751 | A | * | 5/1989 | Iwase et al. | 15/190 |
| 4,997,107 | A | | 3/1991 | Snyder et al. | |
| 5,048,725 | A | | 9/1991 | Peterson | |
| D322,528 | S | | 12/1991 | Matheopoulos | |
| 5,131,567 | A | | 7/1992 | Lipsey | |
| 5,167,348 | A | | 12/1992 | Okami et al. | |
| 5,178,302 | A | | 1/1993 | Cheng | |
| 5,195,659 | A | | 3/1993 | Eiskant | |
| 5,309,605 | A | * | 5/1994 | Sato | 24/67.9 |
| 5,743,434 | A | * | 4/1998 | Light | 222/103 |
| 5,920,967 | A | * | 7/1999 | Souza | 24/563 |
| 6,393,675 | B1 | * | 5/2002 | Gaetke | 24/563 |
| 6,457,218 | B1 | * | 10/2002 | Lawrence | 24/563 |

* cited by examiner

*Primary Examiner*—J. Casimer Jacyna
(74) *Attorney, Agent, or Firm*—Welsh & Katz, Ltd.

(57) ABSTRACT

The present invention is a tube clip for securing the coiled/rolled up end of tubes such as toothpaste, salves, ointments and the likes, thus eliminating the possibility of the tube unrolling and keeping the manufacturers product continually at the ready.

6 Claims, 1 Drawing Sheet

TUBE CLIP FOR A COILED TOOTHPASTE TUBE

BACKGROUND OF THE INVENTION

1. Field of the Invention

The present invention relates to the general field of tube closures. Tube closures having the ability to control the contents of a manufacturers product within the confines of a container. Such containers are known as a tube, and control the egress of the contents of tubes of e.g. salves, balms, ointments, glues, and toothpastes. The manufacturers product and particularly toothpaste, must be maintained for immediate use.

2. Discussion of Prior Art

Throughout the history of extracting manufacturers products from tubes, numerous devices have been invented, patented and in some cases, manufactured in an effort to solve the ongoing problem of rolling up the spent end of a tube of toothpaste et al, and keeping it rolled up when pressure is applied at the distal end of the tube while attempting to use the product. A partial list of such devices ranges from squeezers, rollers, dispensers both manual and electric, compressors, keys, tube winders and yesterdays washing machines with the double roller crank wringers, apparatus dispensers and squeezing vessels. The problem is and remains that one must extract as much of the manufacturers product from a tube as possible. When tubes were made of lead, there was no problem. Just roll up the spent end of the tube and it remained rolled. However, the lead tube is no longer in use. Now, the collapsible plastic tube is predominantly used, and when the spent end of the collapsible plastic tube is rolled up, it will immediately unroll to its previous shape.

OBJECTS AND ADVANTAGES

The benefit and advantage of the present invention is to eliminate uncoiling/unrolling of collapsible plastic tube(s) of toothpaste and the likes.

Another benefit of the present invention is the preclusion of the remaining contents of the tube and the like from escaping beyond the rolled up portion of the collapsible plastic tubes.

It is a further benefit of the present invention to obtain an uninterrupted flow of the product from what now represents an ever full tube. Each time the spent end of the tube is rolled another one half turn or another one half revolution as the product is used, the tube clip is repositioned to resecure the tube from unrolling. Then the remaining unused portion within the tube is now full again at the ready without interruption.

It is another benefit of the present invention to provide the same functions equally to various sizes, shapes and thickness of all manufacturers of plastic tubes.

Additional objects and advantages of the present invention will become obvious and apparent from the following descriptions and accompanying drawings.

BRIEF SUMMARY OF THE INVENTION

The foregoing and additional objects and advantages of the present invention are accomplished in a new and improved method of controlling the coiled or rolled end of a void/empty or spent end of a collapsible plastic tube of toothpaste and the like. The present invention overshadows the difficulty and adverse circumstances of the prior art by providing a tube clip inserted into the spent end of said plastic tube. The tube clip has no moving parts to break, twist or bend out of shape etc. The present invention is fabricated of a stainless steel or equivalent material into a single "U" shaped piece of construction that will retain its spring tensioned memory indefinitely.

The tube clip may be positioned in place once one revolution of the spent end of the tube has been coiled or rolled.

As the product is used, the consumer(s) will continue to coil or roll up the spent end of the tube and by inserting the narrow portion of the tube clip into the end of the each one half resolution of the coiled tube, i.e. much like installing a paper clip onto several pieces of paper or a tie clasp/clip would secure a tie to a shirt or like a "Bobby" pin for hair, perceivably, the larger portion of the tube clip remains on the outside of the toothpaste tube.

BRIEF DESCRIPTION OF THE DRAWINGS

For the purpose of a better understanding of the present invention, its objects and features will be fully appreciated from the following details of the illustrated embodiment taken in conjunction with accompanying drawings and appended claims.

DETAILED DRAWINGS OF THE INVENTION

Figure 1:
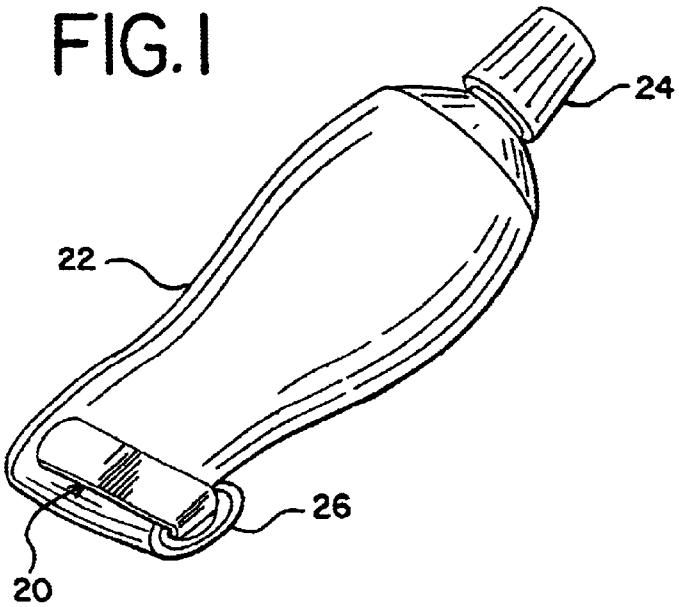
FIG. 1 illustrates a perspective view of an embodiment of the present invention whereby the contents of the tube has been compressed with the tube clip securing the coiled/rolled portion of the spent and of the tube.
Figure 2:
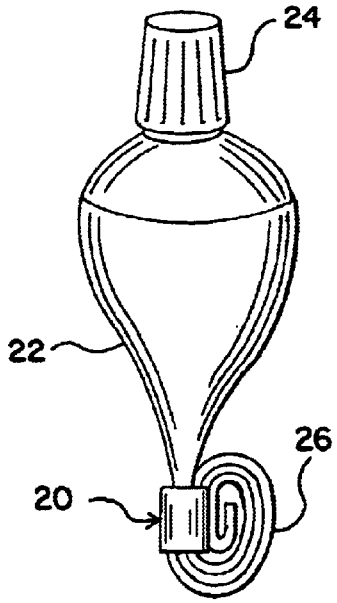
FIG. 2 illustrates an end view of an embodiment of the invention securing the coiled/rolled portion of the spend end with the tube clip in place.
Figure 3:
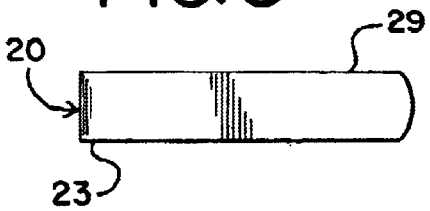
FIG. 3 illustrates a plan view of the tube clip.

Referring now more particularly to the drawings, specific embodiments of the invention are presented in the following illustrated figures. FIGS. 1 and 2 illustrate deformable plastic tube(s) of toothpaste at various stages, ranging from near full to partially empty. Continuing with FIGS. 1 and 2 as the product is used and the contents are expended, a squeegee method or procedure is employed to redistribute the remainder of the product towards the cap 24 end or top of the deformable tube 22 by coiling/rolling 26 the spent end of the tube 22. When all of the above mentioned has been accomplished, the small or spade portion of tube clip 20 (see FIGS. 4 and 5) is inserted into the coiled/rolled end portion of the tube 26 while the larger portion of tube clip 20 overlaps the exterior of the toothpaste tube 22. Each time the contents of a tube begins to diminish the process is repeated keeping the toothpaste tube 22 at its maximum capacity.

The tube clip itself, as stated, is for securing a toothpaste tube in a coiled condition. The toothpaste tube has at least one overlapping segment for placing the tubes in a coiled condition as in FIG. 1 and FIG. 2. The tube clip has first and second elongated planar legs 25 and 29 of a certain width. The width of the second leg 25 is smaller, preferably 0.6 centimeters, than the width of the first leg 29, which is preferably one centimeter.

A resilient bight portion 23 connects the first and second legs to form an integral one-piece clip. The first and second legs are each substantially flat and of minimal thickness, preferably one (1) millimeter or less, with one of the legs, preferably the second leg 25, having an end portion 27 inclined away from the other leg opposite the bight portion 23. The bight portion has a generally circular profile wherein the legs extend at other than and preferably greater than 180° across the generally circular profile. The bight provides a bias which urges the first and second legs toward one another so that the clip secures a toothpaste tube, in a coiled condition by holding the overlapping segment in the coiled condition.

Figure 4:
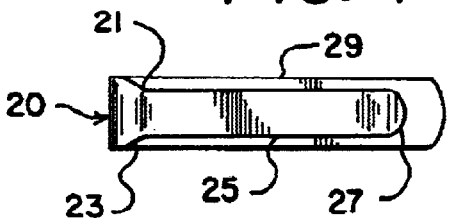
FIG. 4 illustrates a bottom view of the tube clip.
Figure 5:
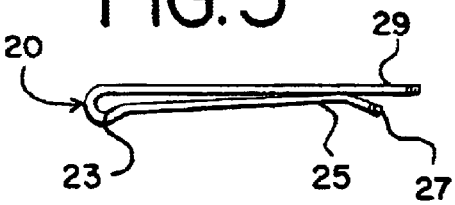
FIG. 5 illustrates a front view of the tube clip.
Figure 6:
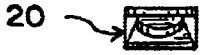
FIG. 6 illustrates an end view of the tube clip.

As shown in FIG. 4, in one embodiment of the invention, the bight portion 23 tapers in width at the connection 21 to said second leg. The first and second legs 25 and 29 may touch each other at a segment opposite the bight portion 23 in the coiled condition, as seen in FIG. 5.

It should be noted that there is no handle or turn key on the clip of the subject invention ending at the bight portion and the inclined end portion, and thus the leg of the subject invention is not used for coiling the tube. The tube is first coiled, the coil is flattened and then the clip of the subject invention is inserted to encompass at least two widths of the flattened, coiled tube portion. The second leg, smaller in width and with the upraised end on the outside of the coiled tube portion, while the larger first leg is on the inside of the coiled holding at least one overlapping segment right against the outside tube portion. The clip holds the tube in the coiled condition and does not allow it to uncoil. Further, the length of the clip is generally less than the width of the toothpaste tube at the coiled end.

While a preferred embodiment of the invention has been described, it will become apparent that those skilled in the art may make modifications, variations and some structural changes without departing from the scope of the invention.

I claim:

1. A method of maintaining a toothpaste tube in a coiled condition, comprising placing a clip into the coiled toothpaste tube, said clip having first and second elongated legs, each having a width;

the width of the second leg being smaller than the width of the first leg;

a resilient bight portion connecting said first and second legs to form a one-piece clip;

said first and second legs being substantially flat, one of said legs having an inclined end portion opposite the bight portion;

said bight portion having a general circular profile wherein the legs extend at other than 180° across the general circular profile;

the bight providing a bias so as to urge said first and second legs toward one another;

wherein the first and second legs maybe inserted about an overlapping segment of the toothpaste tube in the coiled condition, thereby holding the overlapping segment in the coiled condition.

2. The clip of claim 1 wherein the first and second leg touch each other at a leg segment.

3. The clip of claim 2 wherein the first and second by touch each other at a leg segment opposite the bight portion.

4. The clip of claim 1 wherein the bight portion tapers in width at the connection to said second leg.

5. The clip of claim 1 wherein said clip is stainless steel.

6. The clip of claim 1 wherein the length of the clip is less than the width of the tube at said over lapping segment.

* * * * *